US010458031B2

(12) United States Patent
Jung et al.

(10) Patent No.: US 10,458,031 B2
(45) Date of Patent: Oct. 29, 2019

(54) FE—NI ALLOY METAL FOIL HAVING EXCELLENT HEAT RESILIENCE AND METHOD FOR MANUFACTURING SAME

(71) Applicant: POSCO, Pohang-si, Gyeongsangbuk-do (KR)

(72) Inventors: Gwan-Ho Jung, Pohang-si (KR); Jin-You Kim, Pohang-si (KR); Moo-Jin Kim, Incheon (KR); Jae-Kon Lee, Pohang-si (KR); Jun-Hak Park, Pohang-si (KR); Jae-Hwa Hong, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 141 days.

(21) Appl. No.: 15/539,026

(22) PCT Filed: Mar. 25, 2015

(86) PCT No.: PCT/KR2015/002933

§ 371 (c)(1),
(2) Date: Jun. 22, 2017

(87) PCT Pub. No.: WO2016/104871

PCT Pub. Date: Jun. 30, 2016

(65) Prior Publication Data

US 2017/0342581 A1 Nov. 30, 2017

(30) Foreign Application Priority Data

Dec. 23, 2014 (KR) ..... 10-2014-0187635

(51) Int. Cl.

| | |
|---|---|
| ***C22C 19/00*** | (2006.01) |
| ***C22C 35/00*** | (2006.01) |
| ***C21D 6/00*** | (2006.01) |
| ***C25D 1/04*** | (2006.01) |
| ***C22C 19/03*** | (2006.01) |
| ***C25D 5/50*** | (2006.01) |
| ***C21D 9/46*** | (2006.01) |
| ***C22C 38/08*** | (2006.01) |
| *C25D 3/56* | (2006.01) |

(52) U.S. Cl.

CPC ..... *C25D 1/04* (2013.01); *C21D 6/001* (2013.01); *C21D 9/46* (2013.01); *C22C 19/03* (2013.01); *C22C 35/00* (2013.01); *C22C 38/08* (2013.01); *C25D 5/50* (2013.01); *C25D 3/562* (2013.01)

(58) Field of Classification Search

CPC ..... B22F 7/00; B22F 7/008; B22F 2203/05; C22C 19/03; C22C 35/00; C22C 38/08; C22F 1/10

See application file for complete search history.

(56) References Cited

U.S. PATENT DOCUMENTS

| | | | | |
|---|---|---|---|---|
| 6,296,955 | B1 * | 10/2001 | Hossain | G11B 5/66 360/122 |
| 2014/0332069 | A1 | 11/2014 | Yim et al. | |
| 2014/0345677 | A1 | 11/2014 | Yim et al. | |

FOREIGN PATENT DOCUMENTS

| | | | |
|---|---|---|---|
| JP | 2002-280000 | A | 9/2002 |
| KR | 10-2004-0092613 | A | 11/2004 |
| KR | 10-2012-0136931 | A | 12/2012 |
| KR | 10-2013-0053893 | A | 5/2013 |
| KR | 10-2013-0054909 | A | 5/2013 |
| KR | 10-2013-0120239 | A | 11/2013 |
| WO | 2004/094699 | A1 | 11/2004 |
| WO | 2013/073778 | A1 | 5/2013 |

OTHER PUBLICATIONS

Sumiyama et al "Metastable bcc Phase in Sputtered Fe—Ni Alloys", Transactions of the Japan Institute of Metals, vol. 24, No. 4 (1983), pp. 190-194. (Year: 1983).*

Kim et al "Effect of saccaharin addition on the microstructure of electrodeposited Fe-36 wt% Ni alloy", Surface & Coatings Technology 199 (2005) 43-48. (Year: 2005).*

Grimmett et al "A Comparison of DC and Pulsed Fe—Ni Alloy Deposits", J. Electrochem. Soc. vol. 140, No. 4, Apr. 1993, pp. 973-978. (Year: 1993).*

Extended European Search Report dated Dec. 6, 2017 issued in European Patent Application No. 15873399.8.

Wei-Su Chang, et al., "Thermal Stability of Ni—Fe Alloy Foils Continuously Electrodeposited in a Fluorborate Bath," Open Journal of Metal, vol. 2, No. 1, Jan. 1, 2012, pp. 18-23.

International Search Report dated Aug. 31, 2015 issued in International Patent Application No. PCT/KR2015/002933 (with English translation).

S. Koo, et al., "The Prediction of Thermal Deformation of Ni Alloy Substrate for Application of Flexible Solar Cell," The Journal of Korean Society for New and Renewable Energy, May 22, 2008, pp. 382-385 (with English Abstract).

Japanese Office Action dated Sep. 11, 2018 issued in Japanese Patent Application No. 2017-533625, (No English language translation).

Kuto, "The effect of alloy composition on mechanical properties of Tomio-type Fe—Ni alloy electrodeposition films," Nagayama Bulletin of Kyoto City Institute of Industrial Technology, Japan, 2014, No. 4, p. 51-56 (Partial English translation).

* cited by examiner

*Primary Examiner* — Mark Kopec
(74) *Attorney, Agent, or Firm* — Morgan, Lewis & Bockius LLP

(57) ABSTRACT

An aspect of the present invention provides an Fe—Ni alloy metal foil having excellent heat resilience, where the Fe—Ni alloy metal foil is prepared by an electroforming (EF) method and has a thickness of 100 μm or less (except O μm), wherein the Fe—Ni alloy metal foil comprises, by wt %, Ni: 34-46 %, a remainder of Fe and inevitable impurities, and wherein the Fe—Ni metal foil has a degree of heat resilience in an amount of 30 ppm or less.

3 Claims, No Drawings

FE—NI ALLOY METAL FOIL HAVING EXCELLENT HEAT RESILIENCE AND METHOD FOR MANUFACTURING SAME

CROSS REFERENCE

This patent application is the U.S. National Phase under 35 U.S.C. § 371 of International Application No. PCT/KR2015/002933, filed on Mar. 25, 2015, which claims the benefit of Korean Patent Application No. 10-2014-0187635, filed on Dec. 23, 2014, the entire contents of each are hereby incorporated by reference.

TECHNICAL FIELD

The present disclosure relates to an iron (Fe)-nickel (Ni) alloy metal foil having excellent heat resilience and a method of manufacturing the same.

BACKGROUND ART

Metal foils have been developed for a variety of purposes, and are widely used in homes and industries. Aluminum (Al) foils have been widely used for domestic use or for cooking, while stainless steel foils have been commonly used for architectural interior materials or exterior materials. Electrolytic copper foils have been widely used as a circuit of a printed circuit board (PCB). Recently, electrolytic copper foils are being widely used for small devices, such as laptop computers, personal digital assistants (PDA), electronic books, mobile phones, or the like. Metal foils used for special purposes have been manufactured. Iron (Fe)-nickel (Ni) alloy metal foils, among such metal foils have a relatively low coefficient of thermal expansion (CTE), thereby being used as encapsulants for organic light emitting diodes (OLED), an electronic device substrates, or the like. In addition, there is high demand for Fe—Ni alloy metal foils as cathode current collectors and lead frames of secondary batteries.

As a method of manufacturing such Fe—Ni alloy metal foils, a rolling method and an electroforming method have been widely known.

Among them, in the case of a rolling method, after Fe and Ni are cast to be ingots, Fe and Ni are manufactured to be metal foils in such a manner that rolling and annealing is repeated. Since Fe—Ni alloy metal foils manufactured using such a rolling method have a relatively high elongation rate and a smooth surface, cracks may not occur. However, due to mechanical limitations when being manufactured, Fe—Ni alloy metal foils having a width of 1 m or greater are difficult to manufacture, and manufacturing costs thereof are significantly high. In addition, even in a case in which metal foils are manufactured using a rolling method, despite a disadvantage in terms of manufacturing costs, an average grain size of microstructure thereof is coarse, so that mechanical strength properties may be relatively low.

In the meantime, in the case of an electroforming method, metal foils are manufactured in such a manner that an electric current is applied thereto by supplying an electrolyte through an injecting nozzle disposed in a gap between a rotating cylindrical cathode drum disposed in an interior of an electrolytic cell, and a pair of anodes, facing each other and having an arc shape, thereby electrodepositing Fe—Ni alloy metal foils on a surface of the cathode drum to wind the cathode drum. Fe—Ni alloy metal foils manufactured using an electroforming method have a small average grain size, so that mechanical strength properties thereof are relatively high. In addition, since Fe—Ni alloy metal foils may be manufactured using relatively low manufacturing expenses, manufacturing costs thereof are relatively low.

However, in order to use Fe—Ni alloy metal foils manufactured using an electroforming method as encapsulants of organic light emitting devices (OLED), electronic device substrates, or the like, heat treatment at a specific temperature is inevitable. However, in a case in which Fe—Ni alloy metal foils are used in a newly manufactured state thereof, significant thermal deformation occurs when Fe—Ni alloy metal foils are cooled at room temperature after heat treatment at a specific temperature. Such thermal deformation causes contraction greater than that found in a state thereof immediately after Fe—Ni alloy metal foils are manufactured, thereby making a length thereof different from a desired length.

DISCLOSURE

Technical Problem

An aspect of the present disclosure may provide an iron (Fe)-nickel (Ni) alloy metal foil having excellent heat resilience and a method of manufacturing the same.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Technical Solution

According to an aspect of the present disclosure, a method of manufacturing an iron (Fe)-nickel (Ni) alloy metal foil having excellent heat resilience comprises manufacturing the Fe—Ni alloy metal foil having a thickness of 100 μm or less (excluding 0 μm) and including, by wt %, Ni: 34% to 46%, Fe as a residual component thereof, and inevitable impurities, using an electroforming (EF) method; and performing a heat treatment for stabilization of the Fe—Ni alloy metal foil at a heat treatment temperature of 300° C. to 400° C. for 5 to 30 minutes.

According to another aspect of the present disclosure, an Fe—Ni alloy metal foil having excellent heat resilience, manufactured using an EF method and having a thickness of 100 μm or less (excluding 0 μm), is provided. The Fe—Ni alloy metal foil comprises, by wt %, Ni: 34% to 46%, Fe as a residual component thereof, and inevitable impurities and has a heat resilience rate expressed using Formula 1, below, of 30 ppm or lower.

$$\text{Heat resilience rate}=(L-L0)/L0, \quad \text{[Formula 1]}$$

where L0 is a length of a metal foil before heat treatment (at a surface temperature of 30° C.), and L is a length of a metal foil after heat treatment and refers to the length of the metal foil when a surface temperature of an alloy having a surface temperature of 30° C. is increased to 300° C. at a rate of 5° C./min, maintained at a surface temperature of 300° C. for 5 minutes, and decreased to 30° C. at a rate of 5° C./min.

Advantageous Effects

According to an aspect of the present disclosure, an Fe—Ni alloy metal foil has significantly excellent heat resilience, thereby being applied as a material of an encapsulant for an OLED.

BEST MODE FOR INVENTION

As described above, an iron (Fe)-nickel (Ni) alloy metal foil manufactured using an electroforming (EF) method has a small average grain size, so that mechanical strength properties thereof are relatively high. In addition, since the Fe—Ni alloy metal foil may be manufactured at a relatively low manufacturing expense, manufacturing costs thereof are relatively low. However, the Fe—Ni alloy metal foil manufactured using the EF method has a problem in which significant thermal deformation occurs when the Fe—Ni alloy metal foil is cooled at room temperature after heat treatment at a specific temperature.

Thus, the inventors have carried out in-depth research to solve the problem described above and realized the present disclosure.

Hereinafter, the present disclosure will be described in detail. A method of manufacturing the Fe—Ni alloy metal foil of the present disclosure will be described in detail.

First, the Fe—Ni alloy metal foil including, by wt %, Ni: 34% to 46%, Fe as a residual component thereof, and inevitable impurities, is manufactured using the EF method. In other words, as described above, there are a rolling method and the EF method, as the method of manufacturing the Fe—Ni alloy metal foil. Of the two methods described above, in the case of the present disclosure, an alloy metal foil is manufactured using the EF method.

In an exemplary embodiment of manufacturing the Fe—Ni alloy metal foil using the EF method, the Fe—Ni alloy metal foil may be manufactured using a plating solution configured to include an Fe concentration of 1 g/L to 40 g/L, a Ni concentration of 5 g/L to 80 g/L, a ph stabilizer of 5 g/L to 40 g/L, a stress reliever of 1.0 g/L to 20 g/L, and an electroplating additive of 5 g/L to 40 g/L, and having a ph of 1.0 to 5.0, in conditions of plating solution temperatures in a range of 40° C. to 90° C., current density of 1 A/dm2 to 80 A/dm2, and flow velocity of 0.2 m/sec to 5 m/sec. In this case, Fe may be used by melting, to have a salt form, such as iron sulfate, iron chloride, iron sulfamate, or the like, or may be provided by melting electrolytic iron and iron powder in hydrochloric acid or sulfuric acid. In addition, Ni may be used by melting to have a salt form, such as nickel chloride, nickel sulfate, nickel sulfamate, or the like, or may be provided by melting ferronickel, or the like, in acid. Boric acid, citric acid, or the like, may be used as the ph stabilizer, saccharin, or the like, may be used as the stress reliever, and sodium chloride (NaCl), or the like, may be used as the electroplating additive.

A thickness of the Fe—Ni alloy metal foil manufactured using the EF method may be less than or equal to 100 μm (excluding 0 μm) and, more specifically, 50 μm (excluding 0 μm). However, even in a case in which a thickness of a metal foil is beyond a range described above, the present disclosure may be applied thereto. However, in a case in which the thickness of the metal foil is relatively thin in the same manner as the case described above, heat resilience may, in detail, be problematic. Thus, the present disclosure is merely limited to the range described above.

According to an exemplary embodiment, an average grain size of the metal foil may be in a range of 5 nm to 15 nm and, in detail, in a range of 7 nm to 10 nm. In a case in which the average grain size of the metal foil is less than 5 nm, an effect of microstructure stabilization by heat treatment for stabilization thereof, to be subsequently described, may be insufficient. On the other hand, in a case in which the average grain size of the metal foil is greater than 15 nm, strength of the Fe—Ni alloy metal foil may be significantly low after heat treatment for stabilization thereof, to be subsequently described. In this case, the average grain size refers to an average equivalent circular diameter of particles detected by observing a cross section of the metal foil.

In the meantime, the method of manufacturing the Fe—Ni alloy metal foil, in which contents of Fe and Ni are properly controlled and the average grain size is properly controlled, using the EF method, may be implemented using a method known in the art. In the present disclosure, a specific process condition thereof is not specifically limited. For example, the specific process condition may include a ph, current density, plating solution temperature, flow velocity, or the like. It will not be especially difficult for those skilled in the art to obtain the Fe—Ni alloy metal foil by changing the conditions described above.

Subsequently, the Fe—Ni alloy metal foil is heat treated for stabilization thereof. The heat treating the Fe—Ni alloy metal foil for stabilization thereof is to improve heat resilience of the metal foil by the microstructure stabilization.

In this case, heat treatment temperatures for stabilization thereof are in a range of 300° C. to 400° C., in detail, in a range of 300° C. to 345° C., and, specifically, 300° C. to 330° C. In a case in which the heat treatment temperatures for stabilization thereof are lower than 300° C., since the microstructure stabilization is insufficient, the effect of improving heat resilience of the metal foil by heat treatment for stabilization thereof may be insufficient. In a case in which the heat treatment temperatures for stabilization thereof are higher than 400° C., recrystallization of the microstructure rapidly occurs, and heat resilience may not be uniformly implemented, while abnormal grain growth and transformation of an initial form thereof also occur.

In addition, a time for heat treatment for stabilization thereof may be in a range of 5 minutes to 30 minutes, in detail, in a range of 7 minutes to 20 minutes, and, specifically, in a range of 9 minutes to 15 minutes. In a case in which the time for heat treatment for stabilization thereof is less than 5 minutes, since the microstructure stabilization is insufficient, the effect of improving heat resilience of the metal foil by heat treatment for stabilization thereof may be insufficient. On the other hand, in a case in which the time for heat treatment for stabilization thereof is longer than 30 minutes, recrystallization of the microstructure rapidly occurs, and heat resilience may not be uniformly implemented, while abnormal grain growth and transformation of an initial form thereof occur.

In the meantime, in the present disclosure, a heating rate to a heat treatment temperature for stabilization thereof described above is not specifically limited.

In addition, in the present disclosure, after the heat treatment for stabilization thereof described above, a cooling rate from the heat treatment temperature for stabilization thereof to room temperature is not specifically limited. As an example, however, the cooling rate may be less than or equal to 50° C./min(excluding 0° C./min), in detail, less than or equal to 40° C./min(excluding 0° C./min), and, specifically, less than or equal to 30° C./min(excluding 0° C./min). In a case in which the cooling rate is higher than 50° C./min, since the metal foil thermally expanded by heat treatment for stabilization thereof is not sufficiently contracted, heat resilience may be insufficient. In the meantime, when the cooling rate is relatively low, ease of securing heat resilience is facilitated. Thus, a lower limit value thereof is not specifically limited, but may be limited to 0.1° C./min, in consideration of productivity, and the like.

Hereinafter, the Fe—Ni alloy metal foil of the present disclosure will be described in detail.

The Fe—Ni alloy metal foil of the present disclosure is manufactured using the EF method, has the thickness of 100 μm (excluding 0 μm) or less, and includes, by wt %, Ni: 34% to 46%, Fe as a residual component thereof, and inevitable impurities.

Since, in a case in which Ni content is significantly low, a coefficient of thermal expansion may be rapidly increased, and Curie temperature (Tc) is decreased, recrystallization of the microstructure occurs rapidly during heat treatment. Thus, heat resilience may not be uniformly implemented, while abnormal grain growth and transformation of an initial form thereof occur. Thus, a lower limit value of the Ni content may be 34 wt %, in detail, 35 wt %, and, specifically, 36 wt %. On the other hand, in a case in which the content is significantly high, a coefficient of thermal expansion of the metal foil may become significantly higher than that of glass, or the like, thereby causing a problem in being used as an electronic device substrate and an encapsulant for an organic solar cell. Thus, an upper limit value of the Ni content may be 46 wt %, in detail, 44 wt %, and, specifically, 42 wt %.

A residual component of the present disclosure is Fe. However, in a manufacturing process of the related art, unintentional impurities may be mixed from a raw material or a surrounding environment, which may not be excluded. Since the impurities are apparent to those who are skilled in the manufacturing process of the related art, an entirety of contents thereof will not be specifically described in the present disclosure.

The Fe—Ni alloy metal foil of the present disclosure has a heat resilience rate expressed, using Formula 1 below, of 30 ppm or lower, in detail, 20 ppm or lower, and, specifically, ppm or lower, and has significantly excellent heat resilience.

$$\text{Heat resilience rate}=(L-L0)/L0, \quad \text{[Formula 1]}$$

where L0 is a length of a metal foil before heat treatment (at a surface temperature of 30° C.), and L is a length of a metal foil after heat treatment and refers to a length of a metal foil when a surface temperature of an alloy having a surface temperature of 30° C. is increased to 300° C. at a rate of 5° C./min, maintained at a surface temperature of 300° C. for 5 minutes, and decreased to 30° C. at a rate of 5° C./min.

The inventors have carried out in-depth research to provide the Fe—Ni alloy metal foil having excellent heat resilience and discovered that heat resilience of the Fe—Ni alloy metal foil has a significant correlation with the microstructure of the metal foil. In detail, the inventors have discovered that the microstructure of the Fe—Ni alloy metal foil of the present disclosure has a face-centered cubic (FCC) and body-centered cubic (BCC) structure, and proper control a ratio therebetween is a significant factor in securing excellent heat resilience.

According to an exemplary embodiment, an area percentage of BCC may be 5% to 20%, and, in detail, 10% to 20%. In a case in which the area percentage of BCC is less than 5%, recrystallization of the microstructure rapidly occurs, and heat resilience may not be uniformly implemented, while abnormal grain growth and transformation of an initial form thereof occur. On the other hand, in a case in which the area percentage of BCC is greater than 20%, since the microstructure stabilization is insufficient, the effect of improving heat resilience of the metal foil by heat treatment for stabilization thereof may be insufficient.

In the meantime, as described above, in a case in which the microstructure of the Fe—Ni alloy metal foil is controlled and an average grain size is miniaturized, relatively high strength may be secured. In detail, in a case in which the average grain size of the Fe—Ni alloy metal foil is controlled to be less than or equal to 100 nm (excluding 0 nm), relatively high tensile strength of 800 MPa or higher may be secured. In this case, the average grain size refers to the average equivalent circular diameter of particles detected by observing a cross section of the metal foil.

MODE FOR INVENTION

Hereinafter, the present disclosure will be described in more detail through exemplary embodiments. However, an exemplary embodiment below is intended to describe the present disclosure in more detail through illustration thereof, but not to limit the right scope of the present disclosure, because the right scope thereof is determined by the contents written in the appended claims and reasonably inferred therefrom.

EXEMPLARY EMBODIMENT

An Fe—Ni alloy (Fe-42 wt % Ni) is manufactured using a plating solution configured to include an Fe concentration of 8 g/L, a Ni concentration of 20 g/L, a ph stabilizer of 10 g/L, a stress reliever of 2 g/L, and an electroplating additive of 25 g/L, in conditions of a ph of 2.5, current density of 8 A/dm2, and plating solution temperature of 60° C. A thickness of the Fe—Ni alloy that has been manufactured is 20 μm, while an average grain size thereof is 7.1 nm.

Subsequently, the Fe—Ni alloy that has been manufactured is heat treated for stabilization thereof in conditions illustrated in Table 1, below. In this case, a heating rate to a heat treatment temperature for stabilization thereof is 5° C./min, while a cooling rate from the heat treatment temperature for stabilization thereof is 5° C./min, making them uniform.

Subsequently, the average grain size, a BCC area percentage, heat resilience, and tensile strength of an Fe—Ni alloy metal foil that has been heat treated for stabilization thereof are measured, and Table 1, below, illustrates results thereof.

In this case, an evaluation of heat resilience is undergone, based on Formula 1, below.

$$\text{Heat resilience rate}=(L-L0)/L0, \quad \text{[Formula 1]}$$

where L0 is a length of a metal foil before heat treatment (at a surface temperature of 30° C.), and L is a length of a metal foil after heat treatment, and refers to the length of the metal foil when a surface temperature of an alloy having a surface temperature of 30° C. is increased to 300° C. at a rate of 5° C./min, maintained at a surface temperature of 300° C. for 5 minutes, and decreased to 30° C. at a rate of 5° C./min.

TABLE 1

| Remark | Heat Treatment for Stabilization | | Average | BCC Area | Heat | |
|---|---|---|---|---|---|---|
| | Temperature (° C.) | Time (min.) | Grain Size (nm) | Percentage (%) | Resilience Rate | Tensile Strength (GPa) |
| Comparative Example 1 | Uncompleted | | 7.1 | 28.7 | 380 | 1.3 |
| Inventive Example 1 | 300 | 15 | 21.1 | 19.6 | 25 | 1.2 |

TABLE 1-continued

| Remark | Heat Treatment for Stabilization | | Average | BCC Area | Heat | |
|---|---|---|---|---|---|---|
| | Temperature (° C.) | Time (min.) | Grain Size (nm) | Percentage (%) | Resilience Rate | Tensile Strength (GPa) |
| Inventive Example 2 | 350 | 15 | 33.1 | 16.5 | 3.0 | 1.1 |
| Inventive Example 3 | 350 | 30 | 35.4 | 16.0 | 11 | 1.1 |
| Inventive Example 4 | 400 | 15 | 94.2 | 14.8 | 17 | 1.0 |
| Comparative Example 2 | 500 | 15 | 460.1 | 3.9 | 41 | 0.5 |

With reference to Table 1, it can be confirmed that Inventive Examples 1 to 4, satisfying an entirety of process conditions suggested in the present disclosure, have significantly excellent heat resilience, with a heat resilience rate of 30 ppm or lower. In addition, Inventive Examples 1 to 4 also have significantly high tensile strength in such a manner that the average grain size is properly controlled.

On the other hand, in the case of Comparative Example 1, heat treatment for stabilization thereof is not conducted, thereby causing poor heat resilience. In the case of Comparative Example 2, a heat treatment temperature for stabilization thereof is significantly high, thereby causing poor heat resilience.

The invention claimed is:

1. An Fe—Ni alloy metal foil having excellent heat resilience, manufactured using an EF method and having a thickness of 100 μm or less (excluding 0 μm), the Fe—Ni alloy metal foil comprising, by wt %, Ni: 34% to 46%, Fe as a residual component of the Fe—Ni alloy metal foil, and inevitable impurities, wherein microstructure of the Fe—Ni alloy metal foil has a face-centered cubic (FCC) and body-centered cubic (BCC) structure, and an area percentage of BCC is in a range of 5% to 20%, wherein the Fe—Ni alloy metal foil has a heat resilience rate expressed using Formula 1, below, of 30 ppm or lower, $$\text{Heat resilience rate}=(L-L0)/L0, \quad \text{[Formula 1]}$$

where L0 is a length of a metal foil before heat treatment (at a surface temperature of 30° C.), and L is a length of a metal foil after heat treatment and refers to the length of the metal foil when a surface temperature of an alloy having a surface temperature of 30° C. is increased to 300° C. at a rate of 5° C./min, maintained at a surface temperature of 300° C. for 5 minutes, and decreased to 30° C. at a rate of 5° C./min.

2. The Fe—Ni alloy metal foil having excellent heat resilience of claim 1, wherein an average grain size of the Fe—Ni alloy metal foil is less than or equal to 100 nm (excluding 0 nm).

3. The Fe—Ni alloy metal foil having excellent heat resilience of claim 1, wherein tensile strength of the Fe—Ni alloy metal foil is higher than or equal to 800 MPa.

* * * * *